US006544387B2

(12) United States Patent
Huovila et al.

(10) Patent No.: US 6,544,387 B2
(45) Date of Patent: Apr. 8, 2003

(54) MULTI-LAYER HEADBOX FOR A PAPER/BOARD MACHINE

(76) Inventors: Jyrki Huovila, Paavalinvuorentie 32, FIN-40950 Muurame (FI); Juha Kinnunen, Hauhontie 35 A 4, FIN-40520 Jyväskylä (FI); Ari Linsuri, Vuorentie 2, FIN-40950 Muurame (FI); Petri Nyberg, Ruulahdentie 16 B 19, FIN-40520 Jyväskylä (FI)

( * ) Notice: Subject to any disclaimer, the term of this patent is extended or adjusted under 35 U.S.C. 154(b) by 0 days.

(21) Appl. No.: 08/977,973

(22) Filed: Nov. 25, 1997

(65) Prior Publication Data

US 2001/0037867 A1 Nov. 8, 2001

(30) Foreign Application Priority Data

Nov. 26, 1996 (FI) ..... 964704

(51) Int. Cl.[7] ..... D21F 1/08; D21F 1/06; D21F 1/02

(52) U.S. Cl. ..... 162/216; 162/258; 162/259; 162/322; 162/343; 162/DIG. 6

(58) Field of Search ..... 162/188, 203, 162/258, 298, 259, 300, 322, 299, 301, 336, 338, 343, 344, 345, 347, 216, 212, DIG. 6

(56) References Cited

U.S. PATENT DOCUMENTS 4,812,209 A * 3/1989 Kinzler et al. ..... 162/343
5,626,722 A * 5/1997 Huovila ..... 162/343
5,674,363 A * 10/1997 Huovila et al. ..... 162/216
5,688,374 A * 11/1997 Begemann et al. ..... 162/343
5,746,889 A * 5/1998 Huovila et al. ..... 162/216
5,812,404 A * 9/1998 Hamalainen et al. ..... 700/128
5,814,191 A * 9/1998 Huovila ..... 162/216
5,849,159 A * 12/1998 Heinzmann et al. ..... 162/343
5,853,545 A * 12/1998 Haraldsson et al. ..... 162/343
5,900,121 A * 5/1999 Lehleiter et al. ..... 162/322
5,958,189 A * 9/1999 Begemann et al. ..... 162/264
6,210,535 B1 * 4/2001 Huovila et al. ..... 162/322

FOREIGN PATENT DOCUMENTS

| | | |
|---|---|---|
| CA | 2144922 | 9/1995 |
| DE | 4320243 | 12/1994 |
| DE | 4435860 | 3/1995 |
| DE | 4416909 | 11/1995 |
| EP | 0634523 | 1/1995 |
| FI | 951267 | 9/1995 |

* cited by examiner

*Primary Examiner*—Jose A. Fortuna
(74) *Attorney, Agent, or Firm*—Steinberg & Raskin, P.C.

(57) ABSTRACT

A multi-layer headbox for a paper or board machine including stock inlet headers each providing one stock and coupled to a tube bank which in turn is coupled to a respective intermediate chamber. The stock flows from the intermediate chambers into a turbulence generator and through pipes in the turbulence generator into a slice cone to be discharged therefrom onto a forming wire. The multi-layer headbox includes distribution valves for regulating the flow of dilution water across the width of the headbox. Each distribution valve communicates with a distribution plate placed in connection with the tube bank. From each valve, the dilution liquid is distributed at the same time to all the stocks that form the different layers of the web in the multi-layer headbox at a specific position of width of the multi-layer headbox.

19 Claims, 9 Drawing Sheets

MULTI-LAYER HEADBOX FOR A PAPER/BOARD MACHINE

FIELD OF THE INVENTION

The present invention relates to a multi-layer headbox for a paper or board machine including a dilution flow, i.e., a dilution headbox, a method for combining a flow of dilution liquid with flows of stock from inlet headers of a multi-layer headbox of a paper or board machine at a location between the inlet headers and a slice cone of the headbox and a method for regulating the basis weight of a web upon its discharge from a multi-layer headbox of a paper or board machine.

BACKGROUND OF THE INVENTION

With respect to the prior art, reference is made to the constructions described in European Patent No. 0 634 523 and in German Patent Publication Nos. DE 44 35 860 and DE 44 16 909. These publications generally describe the controlled introduction of a dilution liquid into a stock flow in connection with a multi-layer headbox in order to regulate the basis weight of a multi-layer web formed from the headbox across the web width.

When multi-layer paper is produced by a multi-layer headbox, one of the main requirements of the paper is purity of the layers forming the same. This have proven to be difficult to achieve in the prior art multi-layer headboxes.

OBJECTS AND SUMMARY OF THE INVENTION

It is an object of the present invention to provide a new and improved multi-layer headbox which provides suitable purity of the layers of the multi-layer paper produced thereby.

It is another object of the present invention to provide a novel construction of a multi-layer headbox which is suitable both for paper machines and board machines.

It is another object of the present invention to provide a novel method for combining a dilution liquid with flows of stock from inlet headers of a multi-layer headbox.

It is another object of the present invention to provide a novel method for regulating the basis weight profile of a web across the web width.

In order to achieve these objects and others, the multi-layer headbox in accordance with the invention comprises separate inlet headers for each different stock concept and a common distribution plate arranged after the inlet headers in the flow direction of the stock. A dilution liquid is distributed through the distribution plate to one or more desired locations along the web width and, preferably at the same time, into all of the layers of the web at each of those locations in order to regulate the basis weight of the web across the web width. Further, preferably the same amount of dilution liquid, which is favorably dilution water, is passed into each layer.

In the construction of a multi-layer headbox in accordance with the invention, only one valve is needed for regulation of the dilution liquid in each zone of regulation across the width. As such, the construction is less expensive and simpler, compared with prior art constructions. In the construction in accordance with the invention, the layers can be made stable, in which connection even partial mixing together of layers of different consistencies is prevented. Thus, in the construction in accordance with the present invention, the layers remain in equal proportions, which is important when the individual layers are thin, which is the case with printing papers. The optimal field of application of the invention is a three-layer headbox used in the manufacture of printing papers.

Further, in accordance with the invention, the construction of the headbox is such that the constructional portions corresponding to its individual layers are equal to one another both in respect of the numbers of pipes and in respect of the cross-sectional shapes of the pipes, in which case the flow velocities become equal in each layer.

Thus, since the flow velocities in each layer are substantially equal, no impurity of layers, which might arise from differences in the flows, occurs. Further, in the construction in accordance with the invention, long aprons are used in the slice cone between the layers, which aprons become narrower towards their ends and extend substantially over the entire length of the slice cone. Further, intermediate aprons are used in each layer between the horizontal rows of pipes, which intermediate aprons become narrower towards their ends.

In a multi-layer headbox in accordance with the invention, preferably a so-called single-stock system is employed. In a single-stock system, stock is passed from one common tank and branched into branch ducts, whereby fillers and/or admixtures and/or retention agents required by each layer are added to the basic stock in each branch duct.

In a multi-layer headbox in accordance with the invention, there are at least two layers, preferably three. There may also be more than three layers.

Thus, a basic embodiment of a multi-layer headbox in accordance with the invention comprises a dilution inlet header for providing a flow of diluting liquid, a distribution plate arranged between the inlet headers of the headbox and a tube bank, the distribution plate including stock flow pipes each aligning with a respective tube in the tube bank and flow ducts for enabling the diluting liquid to be passed simultaneously into a plurality of selected ones of the stock flow pipes, conduit means for passing the diluting liquid from the dilution inlet header into the flow ducts in the distribution plate, and regulation means for regulating the flow of the diluting liquid through the conduit means. The regulation means may comprise a plurality of distribution valves arranged across a width of the headbox and the conduit means may comprise ducts each coupling a respective valve to one flow duct in the distribution plate.

In one exemplifying embodiment, the tubes in the tube bank are arranged in vertical columns, each arranged at a specific location along the width of the headbox and including a plurality of tubes, such that the stock flow pipes in the distribution plate are arranged in aligned columns. Each flow duct in the distribution plate is then arranged to enable the diluting liquid to be passed into at least two stock flow pipes in a respective column of stock flow pipes, possibly all of the stock flow pipes in the respective column.

The tubes in each row of tubes should have the same cross-sectional shape and be equal in number such that velocities of the flows of the stocks are substantially equal to one another and differences in speed between the flows of the stocks do not cause impurity of layers.

The multi-layer headbox may also comprise a unique stock supply system including a single stock storage tank, means for forming a separate stock flow for each inlet header from the single stock storage tank and passing the separate stock flows into the respective inlet header, and means for independently adding admixtures and/or chemicals and/or retention agents into the separate stock flows.

In the method for combining a flow of dilution liquid with flows of stock from inlet headers of a multi-layer headbox of a paper or board machine at a location between the inlet headers and a slice cone of the headbox, the stock flow from each inlet header is passed through a respective row of stock flow pipes formed in a common distribution plate and extending across a width of the headbox. The stock flow pipes are arranged in vertical columns, each column being arranged at a specific location along the width of the headbox and including one stock flow pipe from each row of stock flow pipes. Flow ducts are formed in the distribution plate, each flow duct being in flow communication with at least two stock flow pipes in a respective column and having a narrowing duct portion. Dilution liquid is directed through at least one, and preferably all, of the flow ducts formed in the distribution plate and from each flow duct through at least two branch ducts in flow communication with the narrowing duct portion thereof and into a respective one of the stock flow pipes in the respective column. The stock flow from each inlet header may be passed through an inlet plate into the distribution plate.

In one specific embodiment, the stock flows are directed from the distribution plate directly into a tube bank including several rows of tubes, each tube aligning with one stock flow pipe such that the tubes are arranged in discrete rows. The stock flow from each row of tubes is directed into and through an individual equalizing chamber and from the equalizing chambers into the slice cone.

In the method for regulating the basis weight of a web upon its discharge from a multi-layer headbox of a paper or board machine, the multi-layer headbox includes two or more inlet headers, each providing a flow of stock which forms a layer of a web. The stock flow from each inlet header is directed through a respective row of stock flow pipes formed in a distribution plate and extending across a width of the headbox. The stock flow pipes are arranged in vertical columns, each column being arranged at a specific location along the width of the headbox and including one stock flow pipe from each rows of stock flow pipes, i.e., the stock flow pipes are arranged in aligned vertical columns and horizontal rows. Dilution liquid is introduced into the stock flow in at least two stock flow pipes in at least one and preferably all of the columns of stock flow pipes by passing the dilution liquid through a plurality of flow ducts formed in the distribution plate. Each flow duct is in flow communication with at least two stock flow pipes in a respective column and includes a narrowing duct portion having an upstream end and a downstream end such that a cross-sectional area defined at the upstream end is greater than a cross-sectional area defined at the downstream end. Further, the dilution liquid is passed from each flow duct through at least two branch ducts in flow communication with the narrowing duct portion of that flow duct and into a respective one of the stock flow pipes in the respective column. The flow of the dilution liquid through the flow ducts regulated as necessary to enable control of the basis weight profile in the direction of width of the web and the stock flows including the dilution liquid are then discharged from the headbox to form the web.

In one specific embodiment, the stock flows are directed from the distribution plate directly into a tube bank including a plurality of rows of tubes, each tube aligning with one stock flow pipe such that the tubes are arranged in discrete rows, and the stock flow from each row of tubes is passed into and through an individual equalizing chamber and from the equalizing chambers into the slice cone.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
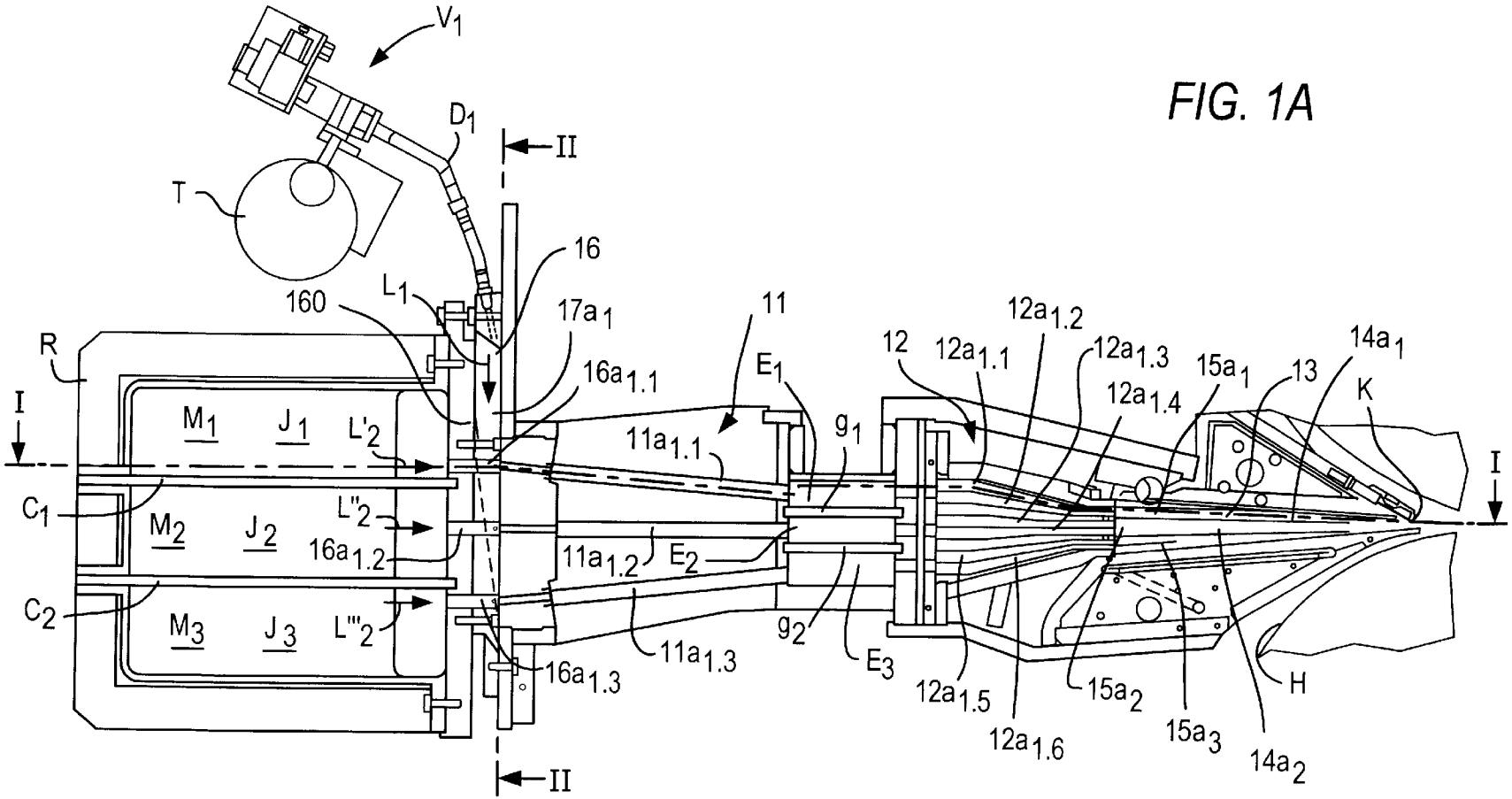
FIG. 1A is a longitudinal sectional view of a multi-layer headbox in accordance with the invention.

Referring to the accompanying drawings wherein like reference numerals refer to the same or similar elements, FIG. 1A is a longitudinal sectional view of a multi-layer headbox 10 in accordance with the invention for a paper or board machine. The multi-layer headbox 10 comprises three stock inlet headers, i.e., headers $J_1$, $J_2$ and $J_3$ for stocks $M_1$, $M_2$ and $M_3$, respectively. Each stock $M_1$, $M_2$, $M_3$ is arranged to be passed from the respective one of the inlet headers $J_1$, $J_2$ and $J_3$ so that the stocks are not mixed with each other and three separate web layers are formed.

The formation of the separate web layers is achieved by directing the stocks $M_1$, $M_2$, $M_3$ to flow out of the respective one of the inlet headers $J_1$, $J_2$, $J_3$ into a tube bank or distributor manifold 11 arranged after the inlet headers in the flow direction of the stock, and more particularly into individual tubes $\mathbf{11}a_{1.1}$, $\mathbf{11}a_{1.2}$, . . . ; $\mathbf{11}a_{2.2}$, . . . in the tube bank, and further, out of these tubes in the tube bank 11 into a respective intermediate chamber $E_1$, $E_2$, $E_3$ related to the stocks $M_1$, $M_2$ and $M_3$, and out of the intermediate chambers $E_1$, $E_2$, $E_3$ into a turbulence generator 12, more particularly into pipes 12$a_{1.1}$, 12$a_{1.2}$, . . . ; 12$a_{2.1}$, 12$a_{2.2}$, . . . , and further into a slice cone 13. In the tube bank 11, tubes 11, tubes 11$a_{1.1}$, 11$a_{1.2}$ and 11$a_{1.3}$ are arranged in a common column while tubes 11$a_{1.1}$, 11$a_{2.1}$, 11$a_{3.1}$, . . . , 11$a_{n.1}$ are arranged in a common row such that the tubes are in aligned columns and rows. Tubes 11$a_{1.1}$, 11$a_{2.1}$, 11$a_{3.1}$, . . . , 11$a_{n.1}$ lead into intermediate chamber $E_1$, tubes 11$a_{1.2}$, 11$a_{2.2}$ 11$a_{3.2}$, . . . , lead into intermediate chamber $E_2$ and tubes 11$a_{1.3}$, 11$a_{2.3}$, 11$a_{3.3}$, . . . , 11$a_{n.3}$ lead into intermediate chamber $E_3$. In the turbulence generator 12, pipes 12$a_{1.1}$, 12$a_{1.2}$, 12$a_{1.3}$, . . . , 12$a_{1.p}$ are arranged in a common column while pipes 12$a_{1.1}$, 12$a_{2.1}$, 12$a_{3.1}$, . . . , 12$a_{m.1}$ are arranged in a common row such that the pipes are in aligned columns and rows.

The slice cone 13 comprises elongate aprons 14$a_1$, 14$a_2$ which extend substantially over the entire length of the slice cone 13. Further, in the slice cone 13, between the two pipes in the vertical row in the slice-cone block or layer provided for each stock $M_1$, $M_2$, $M_3$, an intermediate apron 15$a_1$, 15$a_2$, 15$a_3$ is arranged which is substantially shorter than the aprons 14$a_1$,14$a_2$ that are placed between the blocks and divide the blocks and that extend substantially over the entire length of the slice cone 13 and become narrower towards their ends.

In the headbox in accordance with the invention, the stocks $M_1$, $M_2$ and $M_3$ are passed out of the respective one of the headers $J_1$, $J_2$ and $J_3$ by means of an inlet plate 160, in the manner indicated by arrows $L'_2$, $L''_2$ and $L'''_2$, into flow pipes 16$a_{1.1}$,16$a_{1.2}$, . . . ; 16$a_{2.1}$, 16$a_{2.2}$, . . . in the inlet plate 160. From the inlet plate 160, the flow is passed into stock flow pipes or ducts provided with corresponding numerals in a distribution plate 16, and in the distribution plate 16, the flow of a dilution liquid $L_1$ which originates in a dilution liquid inlet header T is divided into each pipe in the vertical column of pipes so that the dilution liquid $L_1$ is divided substantially uniformly into all of the stocks $M_1$, $M_2$ and $M_3$. From the distribution plate 16, the combined stock flow and dilution water flow is passed into the tubes 16$a_{1.1}$, 16$a_{1.2}$, . . . ; 16$a_{2.1}$,16$a_{2.2}$, . . . in the tube bank 11. From the tubes in the tube bank 11, the stocks $M_1$, $M_2$ and $M_3$ and the dilution flow $L_1$ combined with them are passed into the intermediate chambers $E_1$, $E_2$ and $E_3$. The intermediate chambers $E_1$, $E_2$ and $E_3$ are separated from one another in the vertical direction by means of horizontal walls $g_1$ and $g_2$ extending across the width of the headbox. From the intermediate chamber $E_1$, the stock is passed into the pipes 12$a_{1.1}$,12$a_{1.2}$, . . . ; 12$a_{2.2}$, 12$a_{2.2}$, 12$a_{3.1}$, 12$a_{3.2}$, . . . in turbulence generator 12. From the middle chamber $E_2$, the stock is passed into the middle pipes 12$a_{1.3}$, 12$a_{1.4}$, 12$a_{2.3}$, 12$a_{2.4}$, . . . in the turbulence generator 12, and from the chamber $E_3$, the stock is passed into the pipes 12$a_{1.5}$, 12$a_{1.6}$, 12$a_{2.5}$, 12$a_{2.6}$, . . . in the turbulence generator 12. From the turbulence generator 12, the stocks $M_1$, $M_2$ and $M_3$ and the dilution waters added to them are passed further into the spaces between the main aprons 14$a_1$,14$a_2$ in the slice cone 13 and further onto a forming wire H. In a headbox in accordance with the invention, it is further possible to use an adjustable top slice bar K at the end of the slice cone 13 in order to regulate one or more cross-directional properties of the web as it is discharged from the headbox 10.

As shown FIG. 1A, the inlet headers $J_1$, $J_2$, $J_3$ form a construction enclosed by a unified frame R. A partition wall $C_1$ is arranged between the inlet headers $J_1$ and $J_2$ passing horizontally between the frame R and the inlet plate 160 in order to isolate the inlet headers $J_1$ and $J_2$ from one another. Similarly, a horizontal partition wall $C_2$ is arranged between the inlet headers $J_2$ and $J_3$ passing between the frame R and the inlet plate 160 in order to isolate the inlet headers $J_2$ and $J_3$ from one another.

FIG. 1A illustrates a headbox by whose means it is possible to manufacture three-layer paper. It is obvious that the invention is not confined only to the embodiment described above and that the headbox may also consist of a construction unit that manufactures two-layer paper and comprises two inlet headers $J_1$ and $J_2$ only. In such a case, the distribution plate 16 divides the dilution liquid into the stocks $M_1$and $M_2$. It is also obvious that the invention is also suitable for use in multi-layer headboxes in which there are more than three inlet headers, e.g., inlet headers designated $J_1$, $J_2$, $J_3$, $J_4$, . . . , for more than three different stocks, designated $M_1$, $M_2$, $M_3$, $M_4$ . . .

Figure 2A:
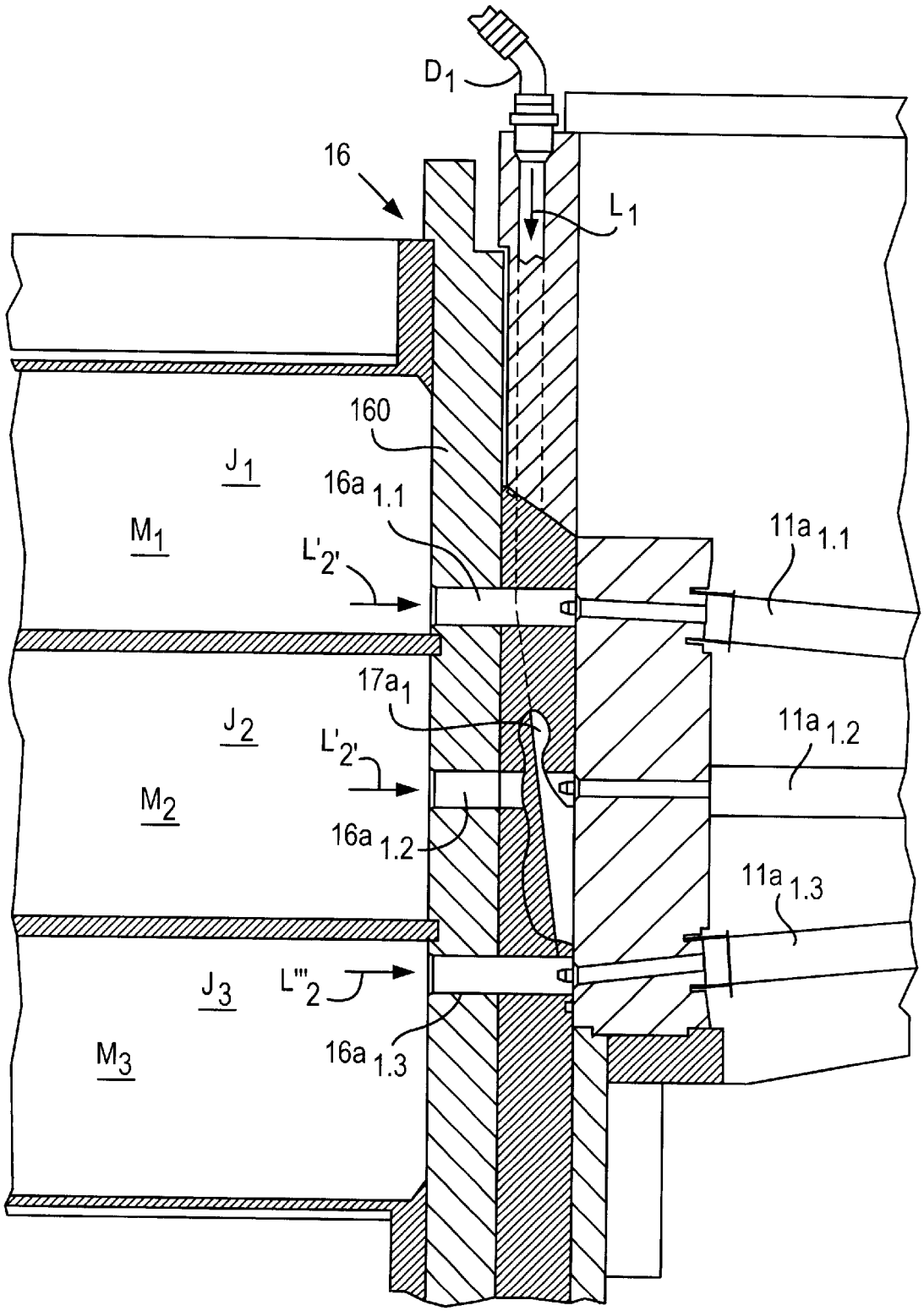
FIG. 2A is an illustration on a larger scale of the supply of dilution liquid into the multi-layer headbox in accordance with the invention into connection with the distribution plate common of its different layers.
Figure 2B:
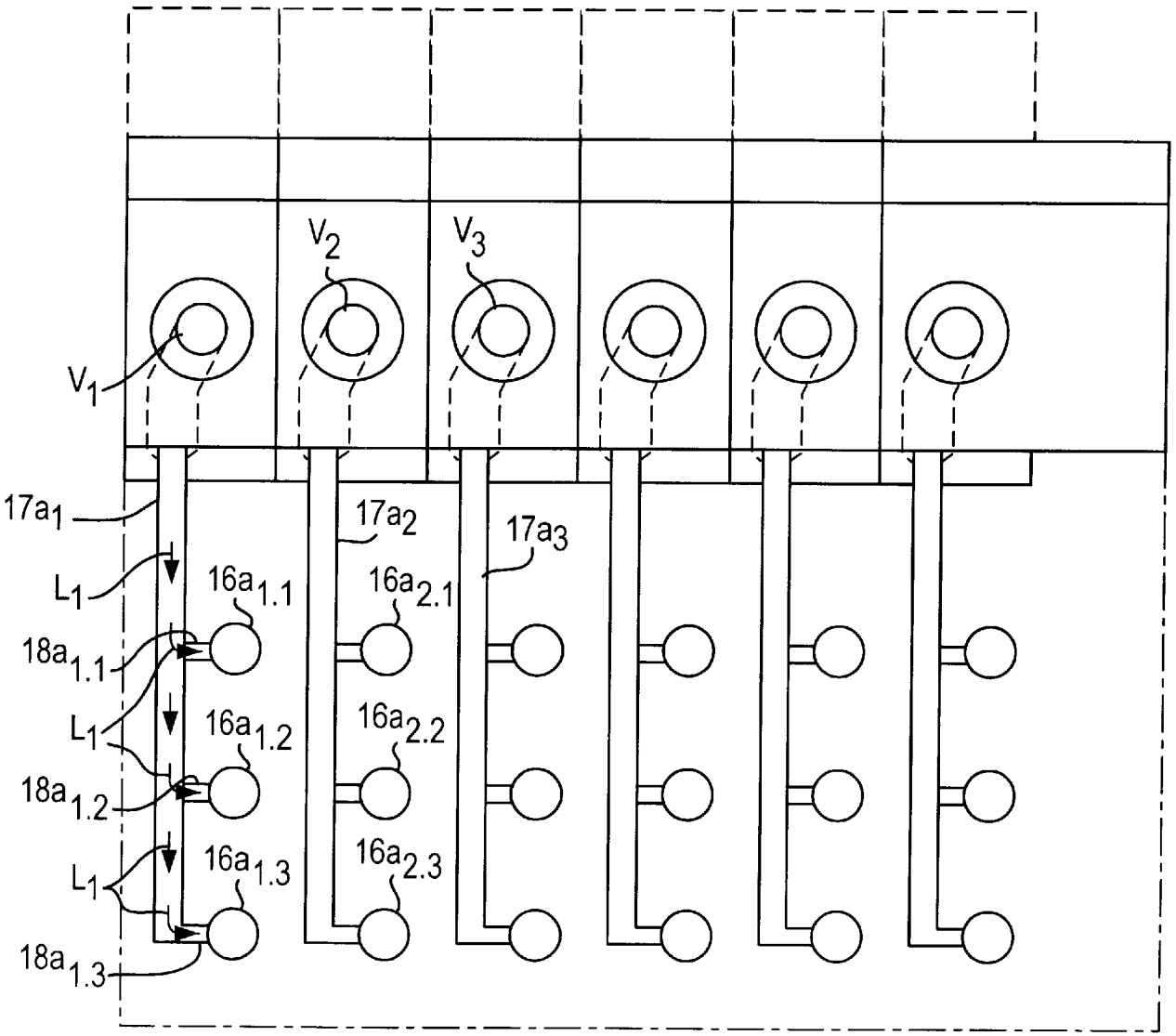
FIG. 2B is a sectional view taken along the line II—II in FIG. 1A and shows the dilution flow being distributed from the narrowing duct at the same time into all the flow pipe components that form the different layers in the multi-layer headbox in each vertical column of stock flow pipes.

FIG. 2B shows the distribution of the dilution liquid through regulation means, such as distribution valves $V_1$,$V_2$, . . . , $V_N$, into the multi-layer headbox in accordance with the invention into different points of width of the headbox and specifically into vertical flow ducts 17$a_1$,17$a_2$, . . . in the distribution plate 16. From the ducts 17$a_1$,17$a_2$, . . . , the dilution liquid is passed further into the stock flow pipes 16$a_{1.1}$,16$a_{1.2}$ . . . ; 16$a_{2.1}$,16$a_{2.2}$ . . . in order to enable regulation of the basis weight of the web. The dilution liquid can be dilution water, for example fibrous or clear water or water taken from the wire as retention. Generally, the concentration of the dilution liquid differs from the concentrations of the stocks $M_1$, $M_2$ and $M_3$, although it is not necessarily a lower, more diluted concentration.

In accordance with the invention, the dilution liquid (arrow $L_1$) is distributed through a valve $V_1$,$V_2$ . . . placed at each point of width, i.e., each location of a column of stock flow pipes 16$a$ across the width of the headbox 10, into connection with the multi-layer headbox 10 to a certain point of width into all the layers in the multi-layer headbox 10, i.e., into connection with the stock $M_1$ as shown in FIG. 1A, into connection with the stock $M_2$ and into connection with the stock $M_3$, to regulate the basis weight of the multi-layer web to be formed across the width of the web.

FIG. 2A is an illustration on a larger scale of the supply of the dilution liquid into a multi-layer headbox in accordance with the invention. As shown in FIG. 2A, the separate distribution plate 16 is employed, which is arranged after the inlet headers $J_1$, $J_2$ and $J_3$ in the stock flow direction $L_2$ ahead of the tube bank 11. In front of the distribution plate 16, there is the inlet plate 160. The separate distribution plate 16, which is arranged in connection with the tube bank 11, comprises flow ducts 17$a_1$, 17$a_2$ . . . narrowing in the direction of flow of the dilution liquid, i.e., each flow duct 17$a$ is defined by walls such that a cross-sectional area defined by the walls at an upstream end of is greater than a cross-sectional area defined by the walls at a downstream end. The dilution liquid $L_1$ coming from the flow duct D, and from the valve $V_1$; from the flow duct $D_2$ and from the valve $V_2$, etc. flows into the connected narrowing duct 17$a_1$,17$a_2$, . . . , from which the flow is distributed further, at the same time, into all of the tubes 16$a_{1.1}$,16$a_{1.2}$, . . . ; 16$a_{2.1}$, 16$a_{2.2}$, . . . in the vertical line of tubes connected with each particular valve $V_1$,$V_2$, . . . In this manner, through the duct 17$a_1$, 17$a_2$, . . . connected to the outlet side of one valve $V_1$,$V_2$, . . . at the distribution plate 16, the dilution water is distributed into all the stocks $M_1$, $M_2$ and $M_3$ in the multi-layer headbox.

FIG. 2A shows the duct 17$a_1$ connected with the valve $V_1$ partly in section, which duct becomes narrower towards its end. By means of the narrowing shape of ducts 17$a_1$, i.e., the inlet end of the ducts 17*a* (the upper end in the illustrated embodiment) have a larger cross-section than the opposite end of the ducts 17*a* (the lower end in the illustrated embodiment), the flow of the diluting liquid can be distributed in the desired manner, preferably uniformly and simultaneously, into all the flow tubes 16$a_{1.1}$, 16$a_{1.2}$ and 16$a_{1.3}$ in the vertical column of tubes. Similarly, through the valve $V_2$, the dilution liquid is distributed into the tubes 16$a_{2.1}$, 16$a_{2.2}$ and 16$a_{2.3}$, etc.

As shown in FIG. 2B, branch ducts 18$a_{1.1}$, 18$a_{1.2}$, 18$a_{1.3}$, . . . are opened into the narrowing duct 17$a_1$. The branch duct 18$a_{1.1}$ distributes the flow $L_1$ from the narrowing duct 17$a_1$ into the tube 16$a_{1.1}$ fluidly coupled to inlet header $J_1$ which provides the stock $M_1$, and similarly the branch duct 18$a_{1.2}$ distributes the flow $L_1$ of dilution liquid from the narrowing duct 17$a_1$ into the tube 16$a_{1.2}$ of the stock $M_2$, and the branch duct 18$a_{1.3}$ distributes the flow from the narrowing duct 17$a_1$, from its lower end, into the tube 16$a_{1.3}$ of the stock $M_3$.

Further, as shown in FIG. 2B, the arrow $L_1$ illustrates the introduction of the dilution flow from the valve $V_1$ into the narrowing duct 17$a_1$, and the arrows illustrate the distribution of the dilution flow into connection with the flows $L'_2$, $L''_2$ and $L'''_2$ that come from the inlet headers $J_1$, $J_2$, $J_3$ of the respective stocks $M_1$, $M_2$, $M_3$.

The headbox 10 is a construction in which the pipe systems and the headbox constructions related to the treatment of each stock $M_1$, $M_2$, $M_3$ are similar to one another, for example, in respect of their pipe numbers and pipe sizes. In this manner, differences between the flow velocities in the different layers are excluded, which differences would further result in impurity of layers. For example, the number of tubes provided for the stock $M_1$ in the tube bank 11 is equal to the number and size of tubes provided for the middle stock $M_2$, and similarly the number and size of the tubes for the stock $M_3$ of the other surface layer are equal to those of the preceding layers. The tubes may also have substantially the same shape. Similarly, the constructions provided for the stocks $M_1$, $M_2$ and $M_3$ are similar to one another at the intermediate chamber and the turbulence generator. The aprons 14$a_1$,14$a_2$ in the slice duct extend preferably over the entire length of the slice duct and become evenly narrower toward their ends. Further, in each layer in the slice duct 13, the headbox in accordance with the invention comprises intermediate aprons 15$a_1$,15$a_2$,15$a_3$, which are substantially shorter than the main aprons 14$a_1$,14$a_2$ (FIG. 1A).

Figure 3:
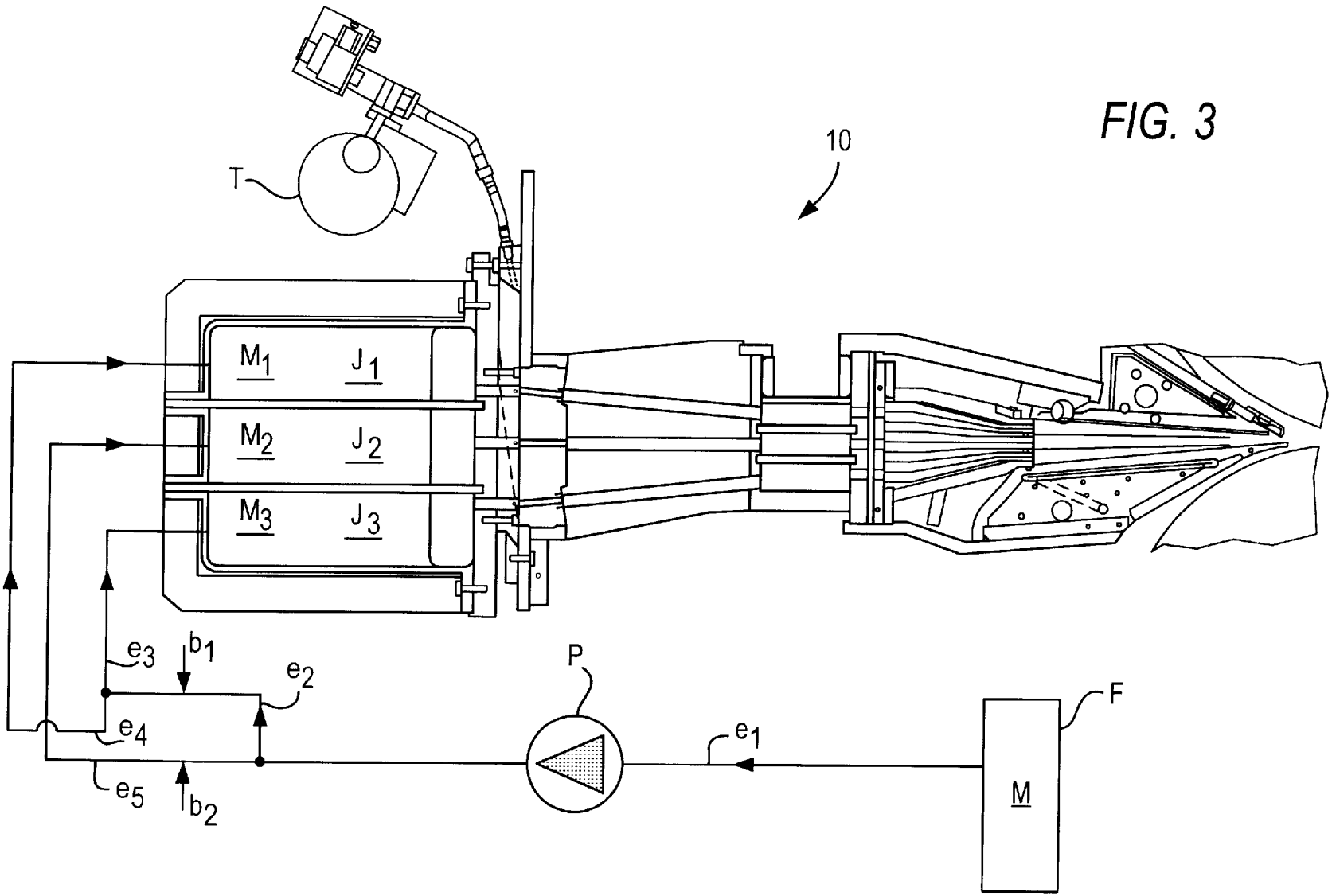
FIG. 3 illustrates the stock system employed in the multi-layer headbox in accordance with the invention.

FIG. 3 illustrates the single stock supply system connected with the multi-layer headbox in accordance with the invention. The stocks $M_1$, $M_2$ and $M_3$ to be passed into the inlet headers $J_1$, $J_2$ and $J_3$ are directed from a single stock tank F placed in connection with the multi-layer headbox. The stocks $M_1$,$M_2$ and $M_3$ are formed out of one common basic stock M by adding the admixtures, fillers and/or retention agents required by the layers to the basic stock M as well as to each individual stock $M_1$, $M_2$ and $M_3$ independently of one another. Thus, the basic stock M is passed from the stock tank F by means of a pump P and branched into branch lines $e_1$,$e_2$,$e_3$,$e_4$,$e_5$, after which the fillers and/or retention agents are added at the points $b_1$ and $b_2$ in compliance with the requirements of each stock $M_1$, $M_2$ and $M_3$.

Figure 4:
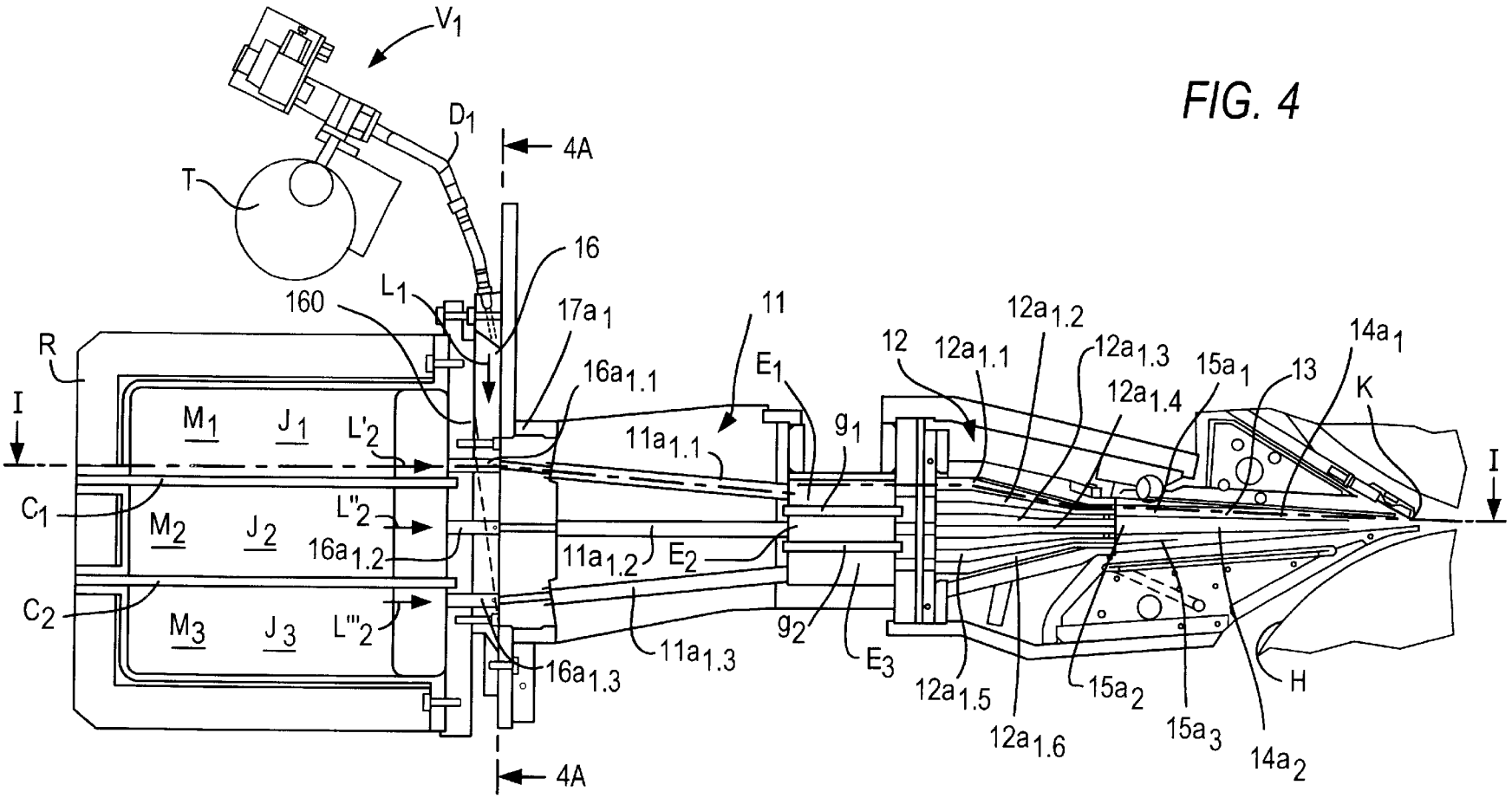
FIG. 4 is a longitudinal sectional view of a second embodiment of multi-layer headbox in accordance with the invention.
Figure 4A:
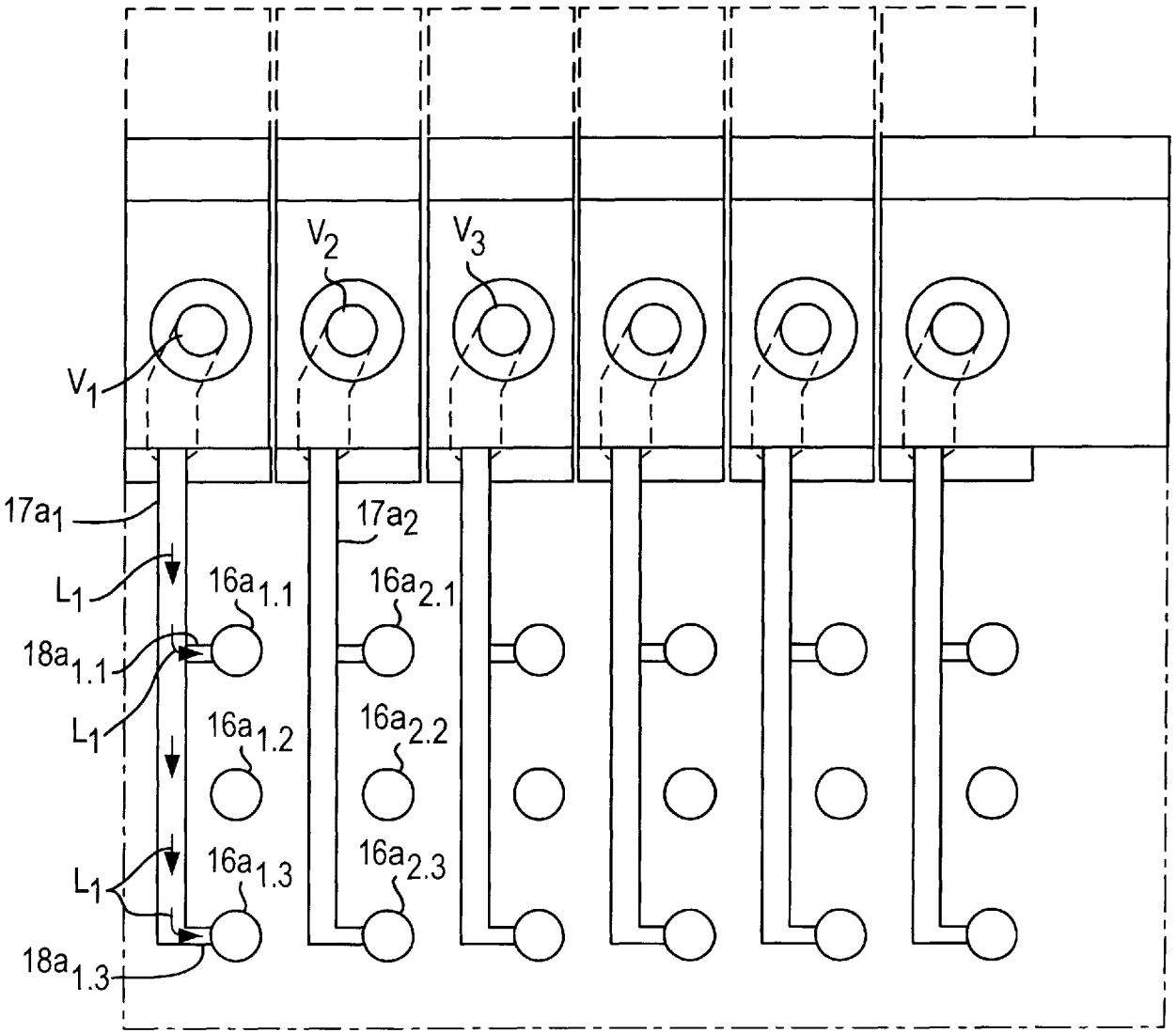
FIG. 4A is a sectional view taken along the line 4A—4A in FIG. 4 and shows the dilution flow being distributed from the narrowing duct at the same time into the uppermost and lowermost flow components that form the upper and lower surface layers of the web formed upon discharge from the multi-layer headbox in each vertical column of stock flow pipes.

FIGS. 4 and 4A show an embodiment wherein the dilution liquid is passed only to a selected portion of the stock flow pipes in the distribution plate 16. Specifically, the dilution liquid is passed from the dilution liquid inlet header T only to the stock which will form the surface layers of the web produced by the multi-layer headbox 10. To this end, the distribution plate 16 comprises flow ducts 17$a_1$, 17$a_2$, . . . narrowing in the direction of flow of the dilution liquid for distributing dilution liquid $L_1$ coming from the associated flow duct D and valve V. From the flow duct $D_1$, the diluting liquid flows into the connected narrowing duct 17$a_1$ and is passed through branch ducts 18$a_{1.1}$,18$a_{1.3}$ simultaneously into the stock flow pipes 16$a_{1.1}$ and 16$a_{1.3}$ only. In this embodiment, there is no connection between the stock flow pipe 16$a_{1.2}$ and the branch duct 17$a_1$ so that the diluting liquid is only introduced into the stocks $M_1$ and $M_3$ which will form the surface layers of the web. From the flow ducts $D_2$, $D_3$, . . . ,$D_n$ the same flow pattern is provided, i.e., through a narrowing duct 17$a_n$ into branch ducts 18$a_{n.1}$ and 18$a_{n.3}$ into respective stock flow pipe 16$a_{n.1}$ and 16$a_{n.3}$. In this manner, through the ducts 17$a_1$, 17$a_2$, . . . connected to the outlet side of the valves $V_1$,$V_2$, . . . at the distribution plate 16, the dilution water is distributed into the stocks $M_1$ and $M_3$ in the multi-layer headbox.

Figure 5:
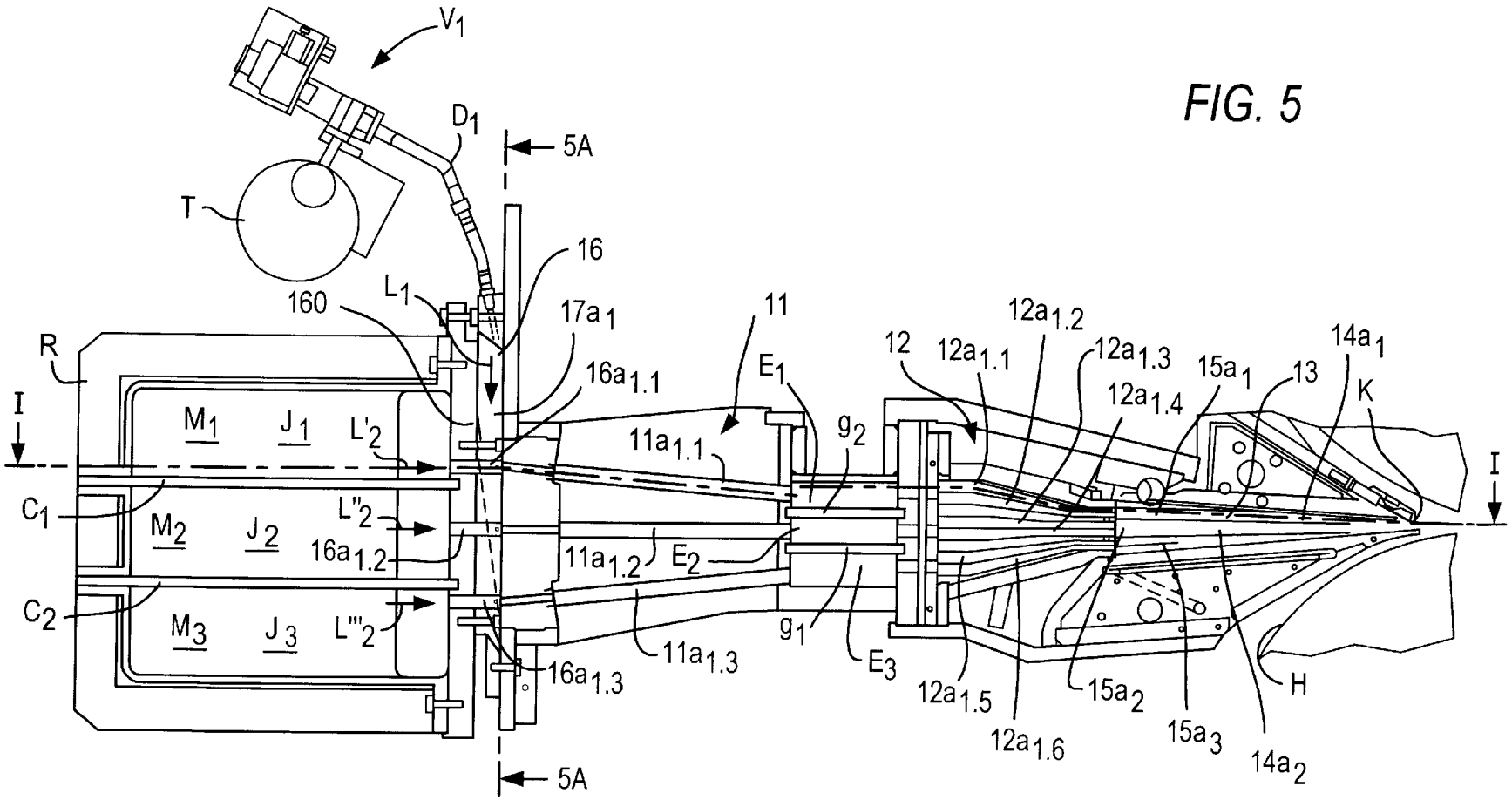
FIG. 5 is a longitudinal sectional view of a third embodiment of multi-layer headbox in accordance with the invention.
Figure 5A:
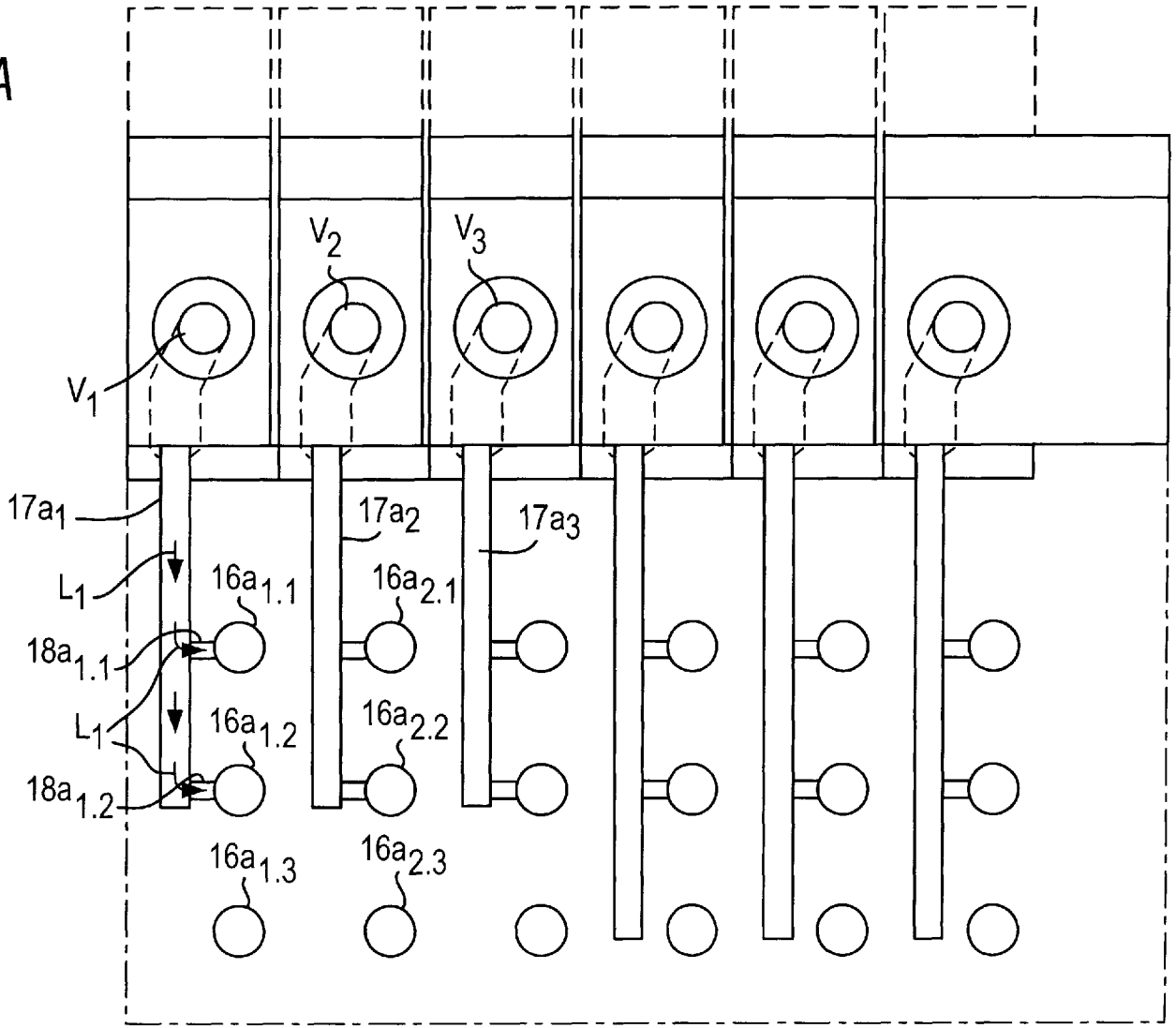
FIG. 5A is a sectional view taken along the line 5A—5A in FIG. 5 and shows the dilution flow being distributed from the narrowing duct at the same time into the uppermost and middle flow components that form the upper surface and middle layers of the web formed upon discharge from the multi-layer headbox in some of the vertical columns of pipes.

FIGS. 5 and 5A show another embodiment wherein the dilution liquid is passed only to a selected portion of the stock flow pipes in the distribution plate 16 after the distribution plate 16. Specifically, the dilution liquid is passed from the dilution liquid inlet header T only to the stock which will form the top surface layer and the middle layer of the web produced by the multi-layer headbox 10. To this end, the distribution plate 16 comprises flow ducts 17$a_1$, 17$a_2$, . . 2. narrowing in the direction of flow of the dilution liquid for distributing dilution liquid $L_1$ coming from the associated flow duct D and valve V. From the flow duct $D_1$, the diluting liquid flows into the connected narrowing duct 17$a_1$ and is passed through branch ducts 18$a_{1.1}$,18$a_{1.2}$ simultaneously into the respective one of the stock flow pipes 16$a_{1.1}$ and 16$a_{1.2}$ only. In this embodiment, there is no connection between the stock flow pipe 16$a_{1.3}$ and the branch duct 17$a_1$, so that the diluting liquid is only introduced into the stocks $M_1$ and $M_2$ which will form the top surface layer and middle layer of the web, respectively. From the flow ducts $D_2$, $D_3$, . . . ,$D_n$ the same flow pattern is provided, i.e., through a narrowing duct 17$a_n$ into branch ducts 18$a_{n.1}$ and 18$a_{n.2}$ into respective stock flow pipes 16$a_{n.1}$ and 16$a_{n.2}$. In this manner, through the ducts 17$a_1$, 17$a_2$, . . . connected to the outlet side of the valves $V_1$,$V_2$, . . . at the distribution plate 16, the dilution water is distributed into the stocks $M_1$ and $M_2$ in the multi-layer headbox.

Figure 1B:
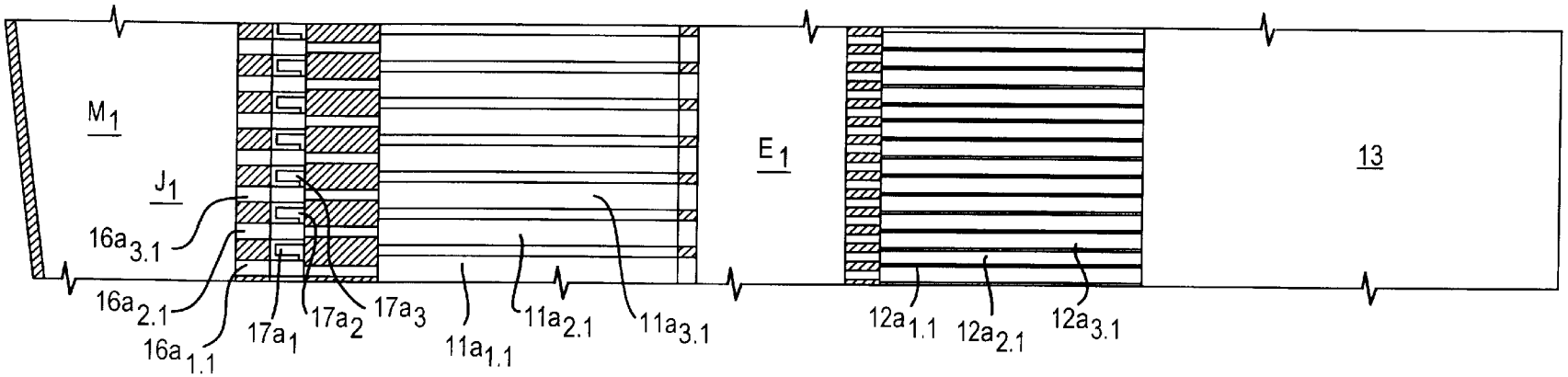
FIG. 1B is a sectional view of the construction shown in FIG. 1A viewed from the top and taken along the line I—I in FIG. 1A.

It is of course possible to construct the distribution plate 16 to include flow passages for passing the diluting liquid into other combinations of the stocks in the inlet headers and the invention is not limited to directing the diluting liquid into all of the stocks (FIGS. 1–3), only the stock which will form surface layers of the web (FIGS. 4 and 4A) and the stock which will form a top surface layer and a middle layer of the web (FIGS. 5 and 5A).

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. In a multi-layer headbox for a paper or board machine including a plurality of stock inlet headers, each of said inlet headers providing a flow of stock which forms a layer of a web, at least one tube bank, each of said at least one tube bank including a plurality of rows of tubes arranged in flow communication with a respective one of said inlet headers and receiving the stock flow from said inlet header, and a slice cone arranged after said at least one tube bank for receiving the stock flows from said at least one tube bank and discharging the stock onto a forming wire, the improvement comprising:

a single dilution liquid inlet header, a plurality of dilution liquid inlet pipes arranged in a cross-machine direction and defining a plurality of regulation zones across a width of said web, each of said single dilution liquid inlet header providing a flow of diluting liquid to at least two layers of said web in each of said regulation zones, a distribution plate arranged between said inlet headers and a first one of said at least one tube bank in a stock flow direction, said distribution plate including stock flow pipes each aligning with a respective one of said tubes in said first tube bank and flow ducts for enabling the diluting liquid to be passed simultaneously into at least two selected layers of said web, conduit means operatively coupled to the single dilution liquid inlet header for passing the flow of diluting liquid from the single dilution inlet header into a corresponding one of said flow ducts in said distribution plate, and a single valve operatively coupled between said single dilution inlet header and each conduit means for regulating the flow of the diluting liquid through each of said conduit means for enabling the dilution liquid to be passed and regulated by the single valve simultaneously into at least two selected layers of the web in the regulation zone.

2. The multi-layer headbox of claim 1, further comprising an inlet plate substantially coextensive with said distribution plate and interposed between said inlet headers and said distribution plate, said inlet plate having flow passages aligning with said stock flow pipes in said distribution plate.

3. The multi-layer headbox of claim 1, wherein said tubes in said first tube bank are arranged in vertical columns, each of said columns being arranged at a specific location along the width of the headbox and including a plurality of said tubes, such that said stock flow pipes are arranged in aligned columns, each of said flow ducts in said distribution plate being arranged to enable the diluting liquid to be passed into at least two of said stock flow pipes in a respective one of said columns of stock flow pipes.

4. The multi-layer headbox of claim 3, wherein each of said flow ducts in said distribution plate is arranged to enable the diluting liquid to be passed into all of said stock flow to pipes in a respective one of said columns of stock flow pipes.

5. The multi-layer headbox of claim 3, wherein each of said flow ducts comprises a narrowing duct portion situated alongside said stock flow pipes in the respective one of said columns of stock flow pipes and branch ducts leading from said narrowing duct portion into a respective one of said at least two stock flow pipes in the respective one of said columns of stock flow pipes.

6. The multi-layer headbox of claim 1, wherein said slice cone comprises aprons extending over a length of said slice cone between adjacent flows of the stock.

7. The multi-layer headbox of claim 6, wherein said slice cone further comprises intermediate aprons arranged in the flows of the stocks, said intermediate aprons having a length shorter than a length of said aprons.

8. The multi-layer headbox of claim 1, wherein said tubes in each of said rows of tubes have the same cross-sectional shape and are equal in number such that velocities of the flows of the stocks are substantially equal to one another and differences in speed between the flows of the stocks do not cause impurity of layers.

9. The multi-layer headbox of claim 1, further comprising a single stock storage tank, means for forming a separate stock flow for each of said inlet headers from said single stock storage tank and passing said separate stock flows into the respective one of said inlet headers, and means for independently adding admixtures/chemicals/retention agents into said separate stock flows.

10. The multilayer headbox of claim 1, wherein said tubes in said first tube bank are arranged in vertical columns, each of said columns being arranged at a specific location along the width of the headbox and including at least three of said tubes, such that said stock flow pipes are arranged in aligned columns, each of said flow ducts in said distribution plate being arranged to enable the diluting liquid to be passed into an uppermost one of said stock flow pipes and a lowermost one of said stock flow pipes in a respective one of said columns of said stock flow pipes.

11. The multi-layer headbox of claim 10, wherein each of said flow ducts comprises a narrowing duct portion situated alongside said stock flow pipes in the respective one of said columns of stock flow pipes and branch ducts leading from said narrowing duct portion into a respective one of said uppermost and lowermost stock flow pipes in the respective one of said columns of stock flow pipes.

12. The multi-layer headbox of claim 1, wherein said tubes in said first tube bank are arranged in vertical columns, each of said columns being arranged at a specific location along the width of the headbox and including at least three of said tubes, such that said stock flow pipes are arranged in aligned columns, each of said flow ducts in said distribution plate being arranged to enable the diluting liquid to be passed into an uppermost one of said stock flow pipes and a middle one of said stock flow pipes in a respective one of said columns of stock flow pipes.

13. The multi-layer headbox of claim 12, wherein each of said flow ducts comprises a narrowing duct portion situated alongside said stock flow pipes in the respective one of said columns of stock flow pipes and branch ducts leading from said narrowing duct portion into a respective one of said uppermost and middle stock flow pipes in the respective one of said columns of stock flow pipes.

14. The multi-layer headbox of claim 1, wherein said at least one tube bank comprises said first tube bank and an additional tube bank, said first tube bank being arranged adjacent to said distribution plate and said additional tube bank being arranged adjacent to said slice cone, further comprising means defining a plurality of intermediate chambers between said first tube bank and said additional tube bank, each of said rows of tubes in said first tube bank leading to a respective one of said intermediate chambers.

15. A method for combining a flow of dilution liquid with flows of stock from inlet headers of a multi-layer headbox of a paper/board machine at a location between the inlet headers and a slice cone of the headbox, comprising the steps of:

passing separate and distinct stock flows from each of the inlet headers through a respective row of stock flow pipes formed in a single distribution plate and extending across a width of the headbox, said stock flow pipes being arranged in vertical columns, each of said columns being arranged at a specific location along the width of the headbox and including one of said stock flow pipes from each of said rows of stock flow pipes, passing dilution liquid from a single dilution liquid inlet header in a regulation zone via a single valve through a corresponding flow duct formed in the distribution plate, to at least two of said stock flow pipes in a respective one of each of said columns, said flow duct being in flow communication with at least two of said stock flow pipes in a respective one of said columns to enable the selective delivery of said diluting liquid to at least two selected layers of said web, each of said flow ducts being defined by walls and including a narrowing duct portion having an upstream end and a downstream end, a cross-sectional area defined by said walls at said upstream end being greater than a cross-sectional area defined by said walls at said downstream end, and passing the dilution liquid from said flow duct through at least two branch ducts in flow communication with said narrowing duct portion of said flow duct and into a respective one of said at least two stock flow pipes in the respective one of said columns.

16. The method of claim 15, further comprising the step of:

passing the stock flow from each of the inlet headers through an inlet plate into said distribution plate.

17. The method of claim 15, further comprising the steps of:

passing the stock flows from said distribution plate directly into a tube bank including a plurality of rows of tubes, each of said tubes aligning with one of said stock flow pipes such that said tubes of said tube bank are arranged in discrete rows, passing the stock flow from each of said rows of tubes in said tube bank into and through an individual equalizing chamber, and passing the stock flows from said equalizing chambers into said slice cone.

18. A method for regulating the basis weight of a web upon its discharge from a multi-layer headbox of a paper/board machine, the multi -layer headbox including a plurality of inlet headers, each of said inlet headers providing a flow of stock which forms a layer of a web, the method comprising the steps of:

passing the stock flow from each of said inlet headers through a respective row of stock flow pipes formed in a distribution plate and extending across a width of the headbox, said stock flow pipes being arranged in vertical columns, each of said columns being arranged at a specific location along the width of the headbox and including one of said stock flow pipes from each of said rows of stock flow pipes, introducing dilution liquid from a single dilution liquid inlet header into the stock flow in at least two of said stock flow pipes in to a corresponding one of said columns of stock flow pipes by passing dilution liquid through a corresponding flow duct formed in the distribution plate, said flow duct being in flow communication with at least two of said stock flow pipes in a respective one of said columns to enable the selective delivery of said diluting liquid to at least two selected layers of said web, said flow duct being defined by walls and including a narrowing duct portion having an upstream end and a downstream end, a cross-sectional area defined by said walls at said upstream end, proximate a first of said at least two stock flow pipes, being greater than a cross-sectional area defined by said walls at said downstream end, proximate a second of said at least two stock flow pipes, and passing the dilution liquid from said flow duct through at least two branch ducts in flow communication with said narrowing duct portion of said flow duct and into a respective one of said at least two stock flow pipes in the respective one of said columns, regulating the flow of the dilution liquid through each of said flow ducts by a valve operatively coupled to the single inlet header, and discharging the stock flows including the dilution liquid from the headbox to form the web.

19. The method of claim 18, further comprising the step of:

passing the stock flows from said distribution plate directly into a tube bank including a plurality of rows of tubes, each of said tubes aligning with one of said stock flow pipes such that said tubes of said tube bank are arranged in discrete rows, passing the stock flow from each of said rows of tubes in said tube bank into and through an individual equalizing chamber, and passing the stock flows from said equalizing chambers into said slice cone.

* * * * *

UNITED STATES PATENT AND TRADEMARK OFFICE

CERTIFICATE OF CORRECTION

PATENT NO. : 6,544,387 B2
APPLICATION NO. : 08/977973
DATED : April 8, 2003
INVENTOR(S) : Jyrki Huovila et al.

It is certified that error appears in the above-identified patent and that said Letters Patent is hereby corrected as shown below:

Title Page
Item 73 should read: Metso Paper, Inc., Helsinki, Finland

Signed and Sealed this

First Day of April, 2008

JON W. DUDAS
*Director of the United States Patent and Trademark Office*